US008437483B2

(12) United States Patent
Garg

(10) Patent No.: US 8,437,483 B2
(45) Date of Patent: May 7, 2013

(54) ACTIVE SNUBBER FOR IMPROVING STABILITY OF HEADPHONE AMPLIFIERS

(75) Inventor: Mayank Garg, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 640 days.

(21) Appl. No.: 12/648,939

(22) Filed: Dec. 29, 2009

(65) Prior Publication Data

US 2011/0158422 A1 Jun. 30, 2011

(51) Int. Cl.
*H04R 3/00* (2006.01)

(52) U.S. Cl.
USPC ..... 381/111; 381/120; 381/74

(58) Field of Classification Search ..... 381/72, 381/74, 370, 71.6, 71.1, 120, 111
See application file for complete search history.

(56) References Cited

U.S. PATENT DOCUMENTS

| | | | | |
|---|---|---|---|---|
| 8,139,791 | B1 * | 3/2012 | Toosky | 381/120 |
| 2005/0013447 | A1 * | 1/2005 | Crump et al. | 381/71.6 |
| 2005/0276421 | A1 * | 12/2005 | Bergeron et al. | 381/71.6 |
| 2006/0244527 | A1 * | 11/2006 | Tsuruya | 330/105 |
| 2008/0232610 | A1 * | 9/2008 | Kung | 381/94.1 |

* cited by examiner

*Primary Examiner* — Disler Paul
(74) *Attorney, Agent, or Firm* — Alan A. R. Cooper; Wade J. Brady, III; Frederick J. Telecky, Jr.

(57) ABSTRACT

Audio amplifiers, particularly those employed with headphones, use snubbers to suppress or snub signals within a particular frequency range. Conventional resistive and resistor-capacitor (RC) type snubbers have a number of drawbacks (i.e., require external components and high power consumption). Here, an active snubber is provided that allows for suppression in a desired frequency range without the need for external components and with relatively small footprint and a relatively small power increase.

20 Claims, 3 Drawing Sheets

ACTIVE SNUBBER FOR IMPROVING STABILITY OF HEADPHONE AMPLIFIERS

TECHNICAL FIELD

The invention relates generally to headphone amplifiers and, more particularly, to an active snubber for headphone amplifiers.

BACKGROUND

Turning to FIGS. 1 and 2 of the drawings, conventional headphone systems 100-1 and 100-2 can be seen. Headphones 102 can be generally modeled as an LRC circuit having resistor R1, inductor L, and capacitor C1. The headphones 102 are coupled to a headphone or output terminal HPOUT and a ground terminal GND, where an amplifier (not shown) would apply a signal to the headphones through terminals HPOUT and GND. For system 100-1, a resistive snubber 104-1 is employed (which is a resistor R2 coupled between terminals HPOUT and GND). For system 100-2, an RC snubber 104-2 (which is a resistor R2 and capacitor C2 coupled in series between terminals HPOUT and GND). Snubber 104-1 significantly and aversely affects efficiency, making it poor design choice. Snubber 104-2, on the other hand, can be build to have high impedance in the audible range (20 Hz to 20 kHz) and low impedance for frequencies above 1 MHz (where the amplifier is generally not stable), but this usually requires a capacitor on the order of 50 nF (which generally cannot be put "on-chip"). Therefore, there is a need for an "on-chip" snubber with high efficiency.

SUMMARY

A preferred embodiment of the present invention, accordingly, provides an apparatus is provided. The apparatus comprises a headphone terminal; a first amplifier that is coupled to the headphone terminal; and an active snubber having: a first transistor coupled between a supply rail and the headphone terminals, wherein the first transistor includes a control electrode; a current source that is coupled to the supply rail; a second transistor that is coupled between the current source and the headphone terminal, wherein the second transistor includes a control electrode; and a second amplifier that is coupled between the control electrodes of the first and second transistor, wherein the second amplifier operates as a follower for a first frequency range of a signal applied to the headphone terminal by the first amplifier, and wherein the second amplifier decreases the of impedance the first transistor for a second frequency range of the signal applied to the headphone terminal by the first amplifier.

In accordance with a preferred embodiment of the present invention, the second transistor is diode-connected.

In accordance with a preferred embodiment of the present invention, the active snubber further comprises a plurality of impedance networks, wherein each control electrode from the first and second transistors is coupled to at least one of the impedance networks.

In accordance with a preferred embodiment of the present invention, the active snubber further comprises: a third transistor that is coupled to the supply rail and the second amplifier; and a current mirror that is coupled to third transistor and the first transistor.

In accordance with a preferred embodiment of the present invention, the first and second transistors are NMOS transistors.

In accordance with a preferred embodiment of the present invention, the ratio of the sizes of the first transistor to the second transistors is N:1, wherein N is a positive integer.

In accordance with a preferred embodiment of the present invention, the active snubber further comprises a resistor that is coupled between the first transistor and the headphone terminal.

In accordance with a preferred embodiment of the present invention, an apparatus is provided. The apparatus comprises a headphone terminal; a ground terminal; a first amplifier that is coupled to the headphone terminal; and an active snubber having: a first transistor coupled between a supply rail and the headphone terminals, wherein the first transistor includes a control electrode; a current source that is coupled to the supply rail; a second transistor that is coupled between the current source and the headphone terminal, wherein the second transistor includes a control electrode; and a first impedance network that is coupled between the control electrode of the first transistor and the headphone terminal; a second amplifier having a first input terminal, a second input terminal, and an output terminal, wherein the output terminal of the second amplifier is coupled to the control electrode of the first transistor, and wherein the first input terminal of the second amplifier is coupled to the first impedance network; and a second impedance network that is coupled to the control electrode of the second transistor, the second input terminal of the second amplifier, and the ground terminal.

In accordance with a preferred embodiment of the present invention, the first impedance network further comprises: a resistor that is coupled between the control electrode of the first transistor and the first input terminal of the second amplifier; and a capacitor that is coupled between the first input terminal of the second amplifier and the headphone terminal.

In accordance with a preferred embodiment of the present invention, the second impedance network further comprises: a resistor that is coupled between the control electrode of the second transistor and the second input terminal of the second amplifier; and a capacitor that is coupled between the second input terminal of the second amplifier and the ground terminal.

In accordance with a preferred embodiment of the present invention, the active snubber further comprises: a third transistor that is coupled to the supply rail and the second amplifier; and a current mirror that is coupled to third transistor and the first transistor.

In accordance with a preferred embodiment of the present invention, the first and second transistors are NMOS transistors.

In accordance with a preferred embodiment of the present invention, the ratio of the sizes of the first transistor to the second transistors is N:1, wherein N is a positive integer.

In accordance with a preferred embodiment of the present invention, the active snubber further comprises a resistor that is coupled between the first transistor and the headphone terminal.

In accordance with a preferred embodiment of the present invention, an apparatus is provided. The apparatus comprises an audio source that generates an audio signal; an integrated circuit (IC) having an input terminal, an output terminal, and a ground terminal, wherein the audio source is coupled to the input terminal of the IC, and wherein the IC includes: a supply rail; a first amplifier that is coupled to the input terminal and the output terminal of the IC; a resistor that is coupled to the output terminal; a first NMOS transistor that is coupled to the resistor at its source and the supply rail at its drain; a current source that is coupled to the supply rail; a second NMOS transistor that is coupled to the resistor at its source and the current source at its drain, wherein the second NMOS transistor is diode-connected; a first impedance network that is coupled between the gate of the first NMOS transistor and the output terminal; a second impedance network that is coupled between the gate of the second NMOS transistor and the ground terminal; and a second amplifier having a first input terminal, a second input terminal, and an output terminal, wherein the first input terminal of the second amplifier is coupled to the first impedance network, and wherein the second input terminal of the second amplifier is coupled to the second impedance network, and wherein the output terminal of the second amplifier is coupled to the gate of the first NMOS transistor; and headphones that are coupled to the output terminal and the ground terminal of the IC.

In accordance with a preferred embodiment of the present invention, the resistor further comprises a first resistor, and wherein the first impedance network further comprises: a second resistor that is coupled between the gate of the first NMOS transistor and the first input terminal of the second amplifier; and a first capacitor that is coupled between the first input terminal of the second amplifier and the first resistor.

In accordance with a preferred embodiment of the present invention, the second impedance network further comprises: a third resistor that is coupled between the gate of the second NMOS transistor and the second input terminal of the second amplifier; and a second capacitor that is coupled between the second input terminal of the second amplifier and the ground terminal.

In accordance with a preferred embodiment of the present invention, the current source is a first current source, and wherein the supply rail is a first supply rail, and wherein the active snubber further comprises: a second supply rail; a third NMOS transistor that is coupled to the supply rail at its drain and the output terminal of the second amplifier at its gate; a first PMOS transistor that is coupled to the source of the third NMOS transistor at its source, wherein the first PMOS transistor is diode-connected; a second current source that is coupled between the drain of the first PMOS transistor and the second supply rail; and a second PMOS transistor that is coupled to the source of the first NMOS transistor at its source, the gate of the first PMOS transistor at its gate, and the second supply rail at its drain.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
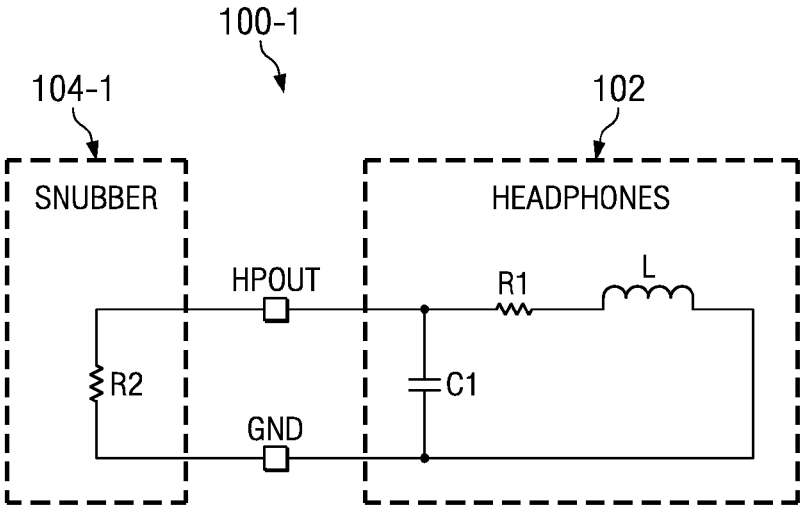
FIG. 1 (PRIOR ART)
FIG. 1 is a diagram of an example of a conventional system using a resistor snubber.
Figure 2:
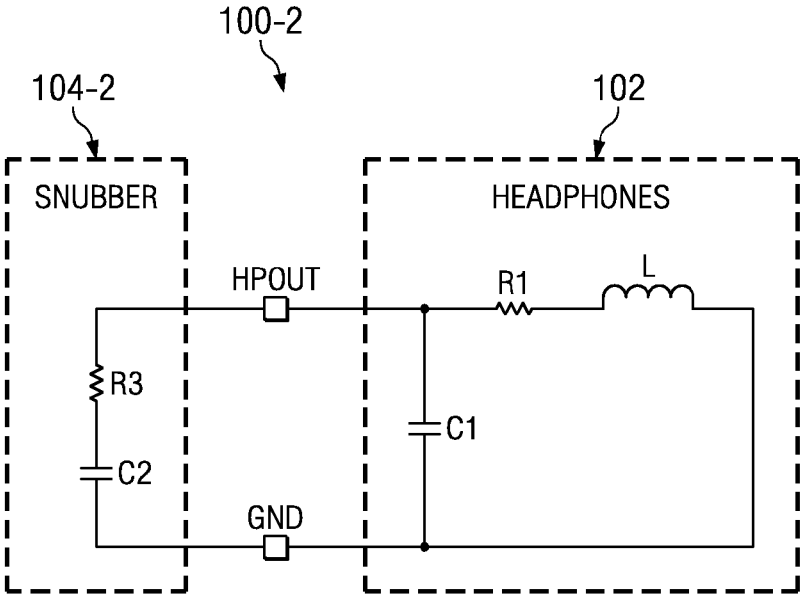
FIG. 2 (PRIOR ART)
FIG. 2 is a diagram of an example of a conventional system using an RC snubber.

Refer now to the drawings wherein depicted elements are, for the sake of clarity, not necessarily shown to scale and wherein like or similar elements are designated by the same reference numeral through the several views.

Figure 3:
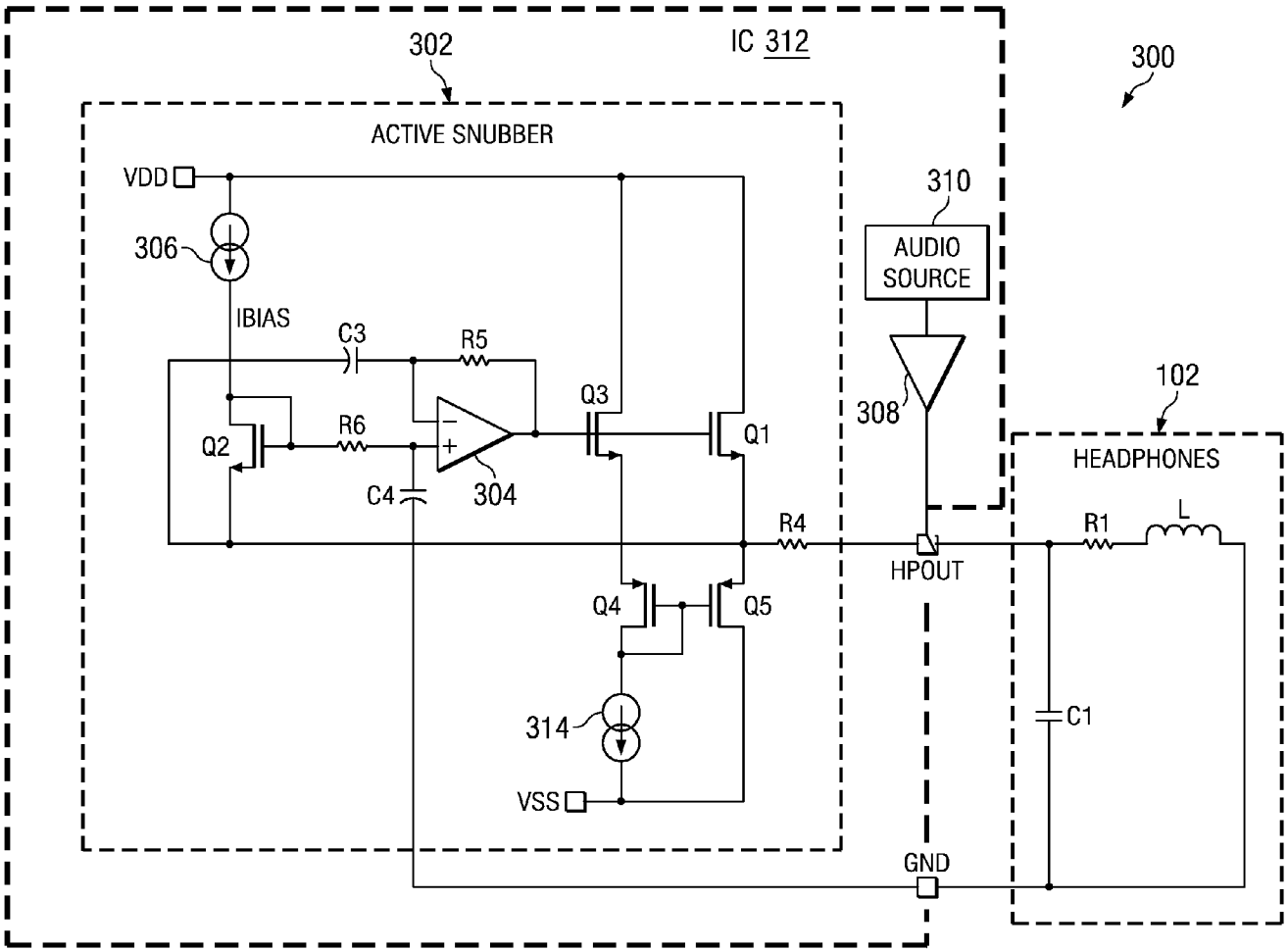
FIG. 3 is a diagram of a system using an active snubber in accordance with a preferred embodiment of the present invention.

Referring to FIG. 3 of the drawings, the reference numeral 300 generally designates a system in accordance with a preferred embodiment of the present invention. The system generally comprises an audio source 310, an integrated circuit (IC) 312, and headphones 102. In operation, the audio source 310 generates an audio signal which is provided to the input terminal IN of IC 312. IC 312 amplifies (and filters) the audio signal and provides it to the headphones 102 through headphone terminal or output terminal HPOUT and ground terminal GND.

Of interest, however, is the IC 312. IC 312 generally comprises an amplifier 308 and an active snubber 302. Additionally, snubber 302 generally comprises resistor R4, impedance networks (resistor/capacitor R5/C3 and resistor/capacitor R6/C4), current source 306, amplifier 304, and NMOS transistors Q1 and Q2.

In operation, the snubber 302 allows signals output from amplifier 308 within the audible frequency range (about 20 Hz to about 20 kHz) to pass to the headphones 102. Preferably, current source 306 (which is coupled to supply rail VDD) generates a bias current $I_{BIAS}$, which is provided to diode-connected NMOS transistor Q2, so to generate a small quiescent current through resistor R4 (which is coupled to output terminal HPOUT). When a signal within an audible range is provided by amplifier 308, capacitors C3 and C4 have high impedance, causing amplifier 304 to have unity gain (operating as a follower). Essentially, for this low frequency range, the gate voltage ($V_G$) for transistor Q1 follows the voltage output through terminal HPOUT (plus a DC bias which is generally equal to a gate-source voltage drop across transistor Q2). Because the gates-source voltage of transistor Q1 is generally constant, the effective impedance of transistor Q1 looking into the source terminal is high, and in order to function in this manner, transistors Q1 and Q2 are operating in a saturated region.

The gate of transistor Q2 is also biased at the same voltage as the gate of transistor Q1, and because transistor Q1 is N times larger than transistor Q2, transconductance ($g_{m1}$) is higher than transconductance ($g_{m2}$) of transistor Q2 for the same bias voltage. Additionally, as the frequency rises (generally above a few hundred kilohertz), snubber 302 can suppress or snub the signal from amplifier 308. With this increase in frequency, the impedance of the capacitor C3 decreases so that the node N1 no longer follows the voltage (signal) at terminal HPOUT. Consequently, resistor R5 and capacitor C3 in combination with amplifier 304 generate an increased, inverted gain (G) to cause the gate voltage ($V_G$) on transistor Q1 to increase while being out of phase with the voltage (signal) at terminal HPOUT. Ideally, the phase shift is 180° to obtain an impedance ($Z_{OUT}$) of $$Z_{OUT} = \frac{1}{g_{m1}}\left(1 + \left|\frac{V_G}{HPOUT}\right|\right) = \frac{(1+G)}{g_{m1}}. \quad (1)$$

Figure 4:
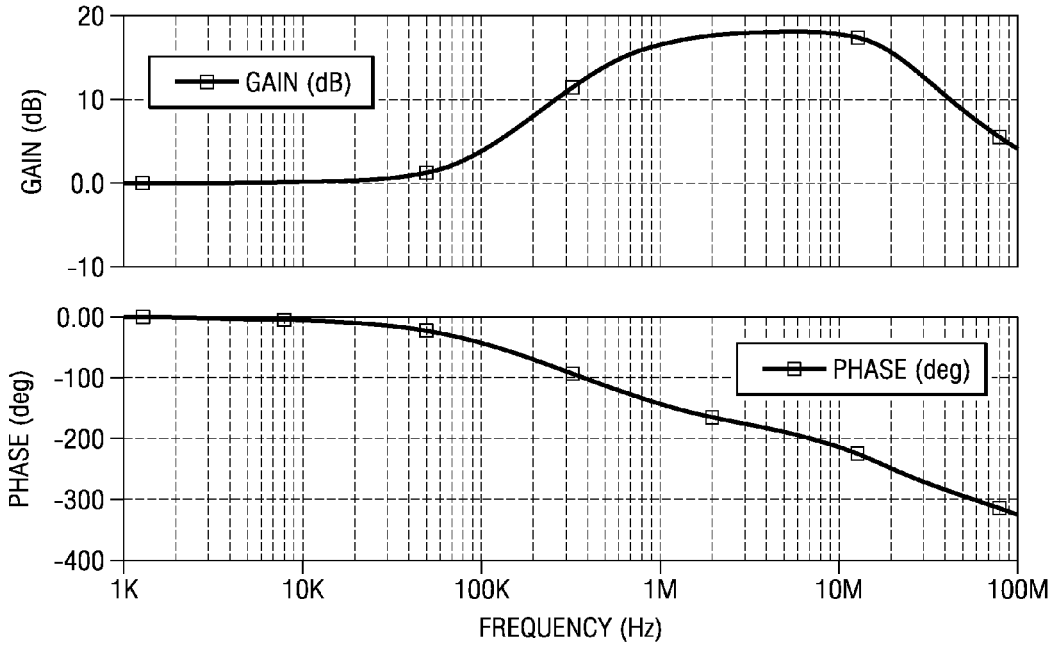
FIG. 4 is a bode plot depicting gain and phase for the system of FIG. 3.

As an example a bode plot of the gain (dB) and phase (degrees) can be seen in FIG. 4, and as shown, the phase is near 180° at 1 MHz (which is also where the gain begins to plateau). Also, the output impedance $Z_{OUT}$ (Ω) and phase (degrees) is shown in FIG. 5, where it can be seen that the impedance greater than 7 kΩ in the audible range (between about 20 Hz and about 20 kHz) and about 150Ω near 1 MHz (where the amplifier 308 tends becomes unstable if the load impedance is larger than a few hundred ohms).

Additionally, to further reduce the impedance of the snubber 302, additional circuitry is provided. In particular, NMOS transistor Q3 (which is about the same size as transistor Q2) is coupled at its gate to the amplifier 304, so the gate voltage of transistor Q3 is generally the same as the gate voltage of transistor Q1. The source of transistor Q3 is coupled to the source of diode-connected PMOS transistor Q4, and the drain of transistor Q4 is coupled to a second current source 314 (which is coupled to supply rail VSS). The ratio of currents in first current source and second current source is 1:1. Additionally, the gate of transistor Q4 is coupled to the gate of PMOS transistor Q5 to form a current mirror (with transistor Q5 being N times larger than transistor Q4), while the source of transistor Q5 is coupled to the source of transistor Q1. This arrangement allows the transconductance ($g_{m5}$) of transistor Q5 to add in parallel with transconductance ($g_{m1}$) of transistor Q1 to reduce the impedance of the snubber 302 to $$Z_{OUT} = \frac{(1+G)}{(g_{m1} + g_{m5})} \quad (2)$$

Figure 5:
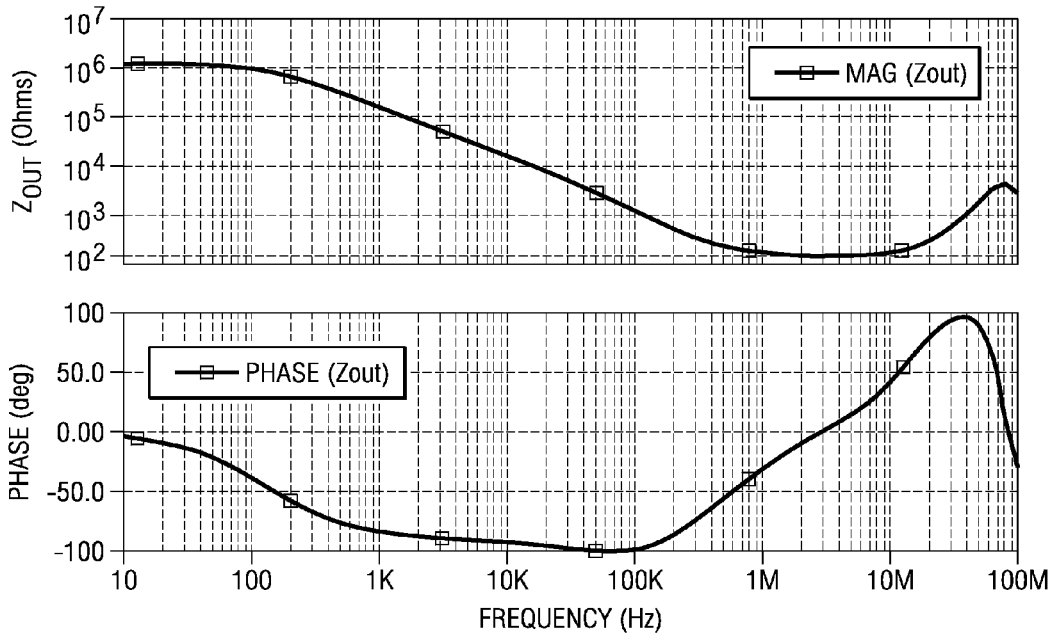
FIG. 5 is a diagram depicting the output impedance and phase for the system of FIG. 3.

The output impedance $Z_{OUT}$ (Ω) and phase (degrees) for active snubber 302 is shown in FIG. 5, where it can be seen that the impedance greater than 7 kΩ in the audible range (between about 20 Hz and about 20 kHz) and about 150Ω near 1 MHz (where the amplifier 308 tends becomes unstable if the load impedance is larger than a few hundred ohms)

To examine the effectiveness of snubber 302, a comparison between snubber 302 and other conventional designs (i.e., snubbers 104-1 and 104-2) can be seen in Table 1 below. In particular, Table 1 shows simulations results for each of snubbers 104-1, 104-2, and 302 with a 10 mW audio amplifier at 1 kHz into 16Ω headphones, and clearly, base on these results, snubber 302 provides significantly better performance with reduced area. It should also be noted that the area calculator for capacitor C2 used for snubber 104-2 assumes the largest density capacitor available "on-chip" was used.

TABLE 1

| Parameter | No Snubber | Snubber 104-1 | Snubber 104-2 | Snubber 302 |
|---|---|---|---|---|
| Worst Case Phase Margin | 33° | 66.7° | 68.8° | 64.4° |
| Worst Case Gain Margin | 8.9 dB | 17.5 dB | 17.1 dB | 15.4 dB |

TABLE 1-continued

| Parameter | No Snubber | Snubber 104-1 | Snubber 104-2 | Snubber 302 |
|---|---|---|---|---|
| Additional Current (Dynamic and Quiescent) | 0 | 2.67 mA | 0.05 mA | 0.081 mA |
| Effective area on chip | 0 | 3,500 $\mu m^2$ | 3,000,000 $\mu m^2$ | 30,000 $\mu m^2$ |

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a headphone terminal;

a first amplifier that is coupled to the headphone terminal; and an active snubber having:

a first transistor coupled between a supply rail and the headphone terminals, wherein the first transistor includes a control electrode;

a current source that is coupled to the supply rail;

a second transistor that is coupled between the current source and the headphone terminal, wherein the second transistor includes a control electrode; and a second amplifier that is coupled between the control electrodes of the first and second transistor, wherein the second amplifier operates as a follower for a first frequency range of a signal applied to the headphone terminal by the first amplifier, and wherein the second amplifier decreases the impedance of the first transistor for a second frequency range of the signal applied to the headphone terminal by the first amplifier.

2. The apparatus of claim 1, wherein the second transistor is diode-connected.

3. The apparatus of claim 2, wherein the active snubber further comprises a plurality of impedance networks, wherein each control electrode from the first and second transistors is coupled to at least one of the impedance networks.

4. The apparatus of claim 3, wherein the active snubber further comprises:

a third transistor that is coupled to the supply rail and the second amplifier; and a current mirror that is coupled to third transistor and the first transistor.

5. The apparatus of claim 1, wherein the first and second transistors are NMOS transistors.

6. The apparatus of claim 5, wherein the ratio of the sizes of the first transistor to the second transistors is N:1, wherein N is a positive integer.

7. The apparatus of claim 1, wherein the active snubber further comprises a resistor that is coupled between the first transistor and the headphone terminal.

8. An apparatus comprising:

a headphone terminal;

a ground terminal;

a first amplifier that is coupled to the headphone terminal; and an active snubber having:

a first transistor coupled between a supply rail and the headphone terminals, wherein the first transistor includes a control electrode;

a current source that is coupled to the supply rail;

a second transistor that is coupled between the current source and the headphone terminal, wherein the second transistor includes a control electrode; and a first impedance network that is coupled between the control electrode of the first transistor and the headphone terminal;

a second amplifier having a first input terminal, a second input terminal, and an output terminal, wherein the output terminal of the second amplifier is coupled to the control electrode of the first transistor, and wherein the first input terminal of the second amplifier is coupled to the first impedance network; and a second impedance network that is coupled to the control electrode of the second transistor, the second input terminal of the second amplifier, and the ground terminal.

9. The apparatus of claim 8, wherein the second transistor is diode-connected.

10. The apparatus of claim 9, wherein the first impedance network further comprises:

a resistor that is coupled between the control electrode of the first transistor and the first input terminal of the second amplifier; and a capacitor that is coupled between the first input terminal of the second amplifier and the headphone terminal.

11. The apparatus of claim 9, wherein the second impedance network further comprises:

a resistor that is coupled between the control electrode of the second transistor and the second input terminal of the second amplifier; and a capacitor that is coupled between the second input terminal of the second amplifier and the ground terminal.

12. The apparatus of claim 8, wherein the active snubber further comprises:

a third transistor that is coupled to the supply rail and the second amplifier; and a current mirror that is coupled to third transistor and the first transistor.

13. The apparatus of claim 8, wherein the first and second transistors are NMOS transistors.

14. The apparatus of claim 13, wherein the ratio of the sizes of the first transistor to the second transistors is N:1, wherein N is a positive integer.

15. The apparatus of claim 8, wherein the active snubber further comprises a resistor that is coupled between the first transistor and the headphone terminal.

16. An apparatus comprising:

an audio source that generates an audio signal;

an integrated circuit (IC) having an input terminal, an output terminal, and a ground terminal, wherein the audio source is coupled to the input terminal of the IC, and wherein the IC includes:

a supply rail;

a first amplifier that is coupled to the input terminal and the output terminal of the IC;

a resistor that is coupled to the output terminal;

a first NMOS transistor that is coupled to the resistor at its source and the supply rail at its drain;

a current source that is coupled to the supply rail;

a second NMOS transistor that is coupled to the resistor at its source and the current source at its drain, wherein the second NMOS transistor is diode-connected;

a first impedance network that is coupled between the gate of the first NMOS transistor and the output terminal;

a second impedance network that is coupled between the gate of the second NMOS transistor and the ground terminal; and a second amplifier having a first input terminal, a second input terminal, and an output terminal, wherein the first input terminal of the second amplifier is coupled to the first impedance network, and wherein the second input terminal of the second amplifier is coupled to the second impedance network, and wherein the output terminal of the second amplifier is coupled to the gate of the first NMOS transistor; and headphones that are coupled to the output terminal and the ground terminal of the IC.

17. The apparatus of claim 16, wherein the resistor further comprises a first resistor, and wherein the first impedance network further comprises:

a second resistor that is coupled between the gate of the first NMOS transistor and the first input terminal of the second amplifier; and a first capacitor that is coupled between the first input terminal of the second amplifier and the first resistor.

18. The apparatus of claim 17, wherein the second impedance network further comprises:

a third resistor that is coupled between the gate of the second NMOS transistor and the second input terminal of the second amplifier; and a second capacitor that is coupled between the second input terminal of the second amplifier and the ground terminal.

19. The apparatus of claim 16, wherein the wherein the ratio of the sizes of the first NMOS transistor to the second NMOS transistors is N:1, wherein N is a positive integer.

20. The apparatus of claim 16, wherein the current source is a first current source, and wherein the supply rail is a first supply rail, and wherein the IC further comprises:

a second supply rail;

a third NMOS transistor that is coupled to the supply rail at its drain and the output terminal of the second amplifier at its gate;

a first PMOS transistor that is coupled to the source of the third NMOS transistor at its source, wherein the first PMOS transistor is diode-connected;

a second current source that is coupled between the drain of the first PMOS transistor and the second supply rail; and a second PMOS transistor that is coupled to the source of the first NMOS transistor at its source, the gate of the first PMOS transistor at its gate, and the second supply rail at its drain.

* * * * *